US007169000B1

(12) United States Patent
Hernandez et al.

(10) Patent No.: US 7,169,000 B1
(45) Date of Patent: Jan. 30, 2007

(54) SWIMMING AID TRAINING DEVICE

(76) Inventors: Miguel Angel Hernandez, 1511 Michigan Ave. #21, Miami, FL (US) 33139; Carlos David Lang, 8000 SW. 11 St., Miami Beach, FL (US) 33144

( * ) Notice: Subject to any disclaimer, the term of this patent is extended or adjusted under 35 U.S.C. 154(b) by 0 days.

(21) Appl. No.: 11/368,167

(22) Filed: Mar. 6, 2006

(51) Int. Cl.
*A63B 31/12* (2006.01)

(52) U.S. Cl. ..... 441/60

(58) Field of Classification Search ..... 441/55, 441/60, 61; 434/254; 482/55, 56, 111–113; D21/803–807

See application file for complete search history.

(56) References Cited

U.S. PATENT DOCUMENTS 4,379,704 A * 4/1983 Rademacher ..... 441/88
4,411,422 A * 10/1983 Solloway ..... 482/111

* cited by examiner

*Primary Examiner*—Ed Swinehart
(74) *Attorney, Agent, or Firm*—Albert Bordas

(57) ABSTRACT

A swimming aid training device to improve swimming technique, comprised a buoy assembly and a fin assembly. The buoy assembly is shaped to fit onto the calf area of a swimmer and has a substantially rotated H-shape. In the preferred embodiment, the buoy assembly is made of resilient and buoyant material. The fin assembly comprises fins that are substantially parallel with respect to each other and are kept in a spaced apart relationship by a frame. The swimming aid training device may be configured for volumetrically efficient transportation and/or storage.

10 Claims, 6 Drawing Sheets

SWIMMING AID TRAINING DEVICE

BACKGROUND OF THE INVENTION

1. Field of the Invention

The present invention relates to swimming aids, and more particularly, to a training device for swimmers.

2. Description of the Related Art

Swimming is enjoyed by many people and is often done for pleasure and/or competition. Competitive swimmers often practice to improve their technique and muscle stamina.

There are four primary forces acting on a swimmer while swimming. In a vertical plane, buoyancy offsets the weight of the swimmer. However, since people have varying natural ability to float, another means of overcoming the swimmer's weight must be employed. This is accomplished from the arm stroke and kick. By pressing down on water, an equal an opposite reaction occurs, which lifts the swimmer higher in the water. The other primary forces are the thrust or propulsive force and drag.

Drag can be divided into two components: pressure drag and skin friction drag. Pressure drag comes from the frontal area exposed to the water and the separation that occurs behind the swimmer. A swimmer must streamline his/her body to reduce the amount of separation. Drag from skin friction, on the other hand, increases when the swimmer becomes more streamlined, since more surface area is exposed to the water. However, this is not really a concern, as the pressure drag is dominant and, therefore, the overall drag decreases.

Generally speaking, the arm stroke produces the majority of the thrust. The difference between swimmers is how the arm stroke is used to produce thrust. The best swimmers not only achieve thrust by pushing back on the water, but also by moving their hands and arms like a propeller. An efficient arm stroke involves moving the arm along a curvilinear path. This way the swimmer is always pushing back on still water. The advantage here is that the still water offers more resistance than the water that is already moving back. The kick provides a stabilizing effect in addition to thrust. Most swimmers only get a small amount of propulsive force from their kick. The first way to improve the kick is to keep the feet in the water. When swimmers feet enter the water, a significant amount of air enters as well. The air increases the drag as well as reducing the propulsive effect. The best swimmers go further by moving their feet during the kick to produce the same lift force achieved by their hands.

Proper swimming technique however, requires much training and improper technique often leads to inefficient swim strokes that slow a swimmer down. There is a need for a swimming aid training device that assists a swimmer to improve swim technique. Several designs for swimming aids have been developed in the past. None of them, however, include a buoy assembly and a fin assembly, wherein the buoy assembly is shaped to fit onto the calf area of a swimmer. A swimmer to improve their swimming technique when swimming wears the instant invention.

Applicant believes that the closest reference corresponds to U.S. Pat. No. 6,364,727 issued to Rangel on Apr. 2, 2002 for Swimming Aid With Movable Fins. However, it differs from the present invention because Rangel teaches a swimming aid that includes a support panel fastened to an arm and/or leg with two movable fins extending along the panel. The fins are configured so that when a swimmer is moving his or her limb in a power stroke, the fins will pivot outwardly to increase the width pushing against the water, increasing swimmer efficiency and speed. During the recovery stroke, the fins pivot back against the limb, reducing the resistance to limb movement. A strap extending through slots in the support panel and the fins serves to hold the assembly to the swimmer's limb while providing the pivot line and the extent to which the fins will pivot during a power stroke. Several different arrangements of support panel, fins and strap path may be used. In one embodiment a further top member of flexible material is secured over the fins opposite the support panel.

Applicant believes another reference corresponds to U.S. Pat. No. 5,055,075 issued to Waller, Jr. on Oct. 8, 1991 for Directional fins for body and body board surfing. However, it differs from the present invention because Waller, Jr. teaches a fin assembly for assisting a body or body board surfer in steering. It is comprised of a vane-like fin member, generally planar shaped and a securing device for securing the fin member to the limb of a surfer so that the fin projects generally downwardly into the water from the undersurface of the surfer's body. Preferably, oppositely directed right and left hand fin members are provided for securing to right and left hand limbs, respectively, of the surfer. The fin member has an enlarged base from which the fin projects, and the securing device is designed to secure the base against the appropriate limb so that the fin projects generally outwardly.

Applicant believes another reference corresponds to U.S. Pat. No. 5,700,173 issued to Lerro on Dec. 23, 1997 for Swimming Instructional Device. However, it differs from the present invention because Lerro teaches a swimming instructional and training aid, comprising a combination floatation and positioning member adapted to encircle or attach to a body joint of the extremities, i.e., the knee, ankle/foot, elbow and wrist/hand joints, the member being relatively rigid yet retaining some flexibility and configured to restrictively maintain the body joint in a preferred angular position as determined by proper swimming technique, the member being comprised of a buoyant material whereby the body joint is lifted to the surface of the water when the member is in place.

Other patents describing the closest subject matter provide for a number of more or less complicated features that fail to solve the problem in an efficient and economical way. None of these patents suggest the novel features of the present invention.

SUMMARY OF THE INVENTION

The instant invention is buoyant and is worn by a swimmer between both legs, below the knees and above the ankles, wherein the fins are pointed in a downward direction.

More specifically, the instant invention is a swimming aid training device, comprising a buoy assembly and a fin assembly. The fin assembly is removably secured to the buoy assembly in a first position. The fin assembly comprises at least two fins and a frame. The fins are kept in a spaced apart relationship by a frame. The fin assembly is a stabilizer to prevent a swimmer from twisting their torso in a body of water to minimize drag and maintain a streamlined position when freestyle swimming. The buoy assembly is worn above ankles and below knees of the swimmer.

The buoy assembly has a substantially rotated H-shape comprising a top wall and a bottom wall that connect by front edge and rear edge, thereby defining front edges and rear edges. The buoy assembly further comprises side walls that are defined between the front edges and the rear edges. The front edges define a larger opening space than the rear edges. The side walls have a C-shape thereby defining bays.

In the preferred embodiment, the fins are substantially parallel. The bottom wall comprises a depressed surface of a predetermined shape to snugly receive the frame when the fin assembly is removably secured to the buoy assembly. The depressed surface comprises at least two apertures, each having a bushing. The bushing is cylindrically shaped and has internal threads. Bolts have heads and threaded portions. The heads have a cooperative shape and dimension to allow the swimmer to tighten the bolts by hand. Each bolt tightens into the bushing to secure the fin assembly to the buoy assembly. The buoy assembly is made of a resilient and buoyant material. The fin assembly is removably secured to the buoy assembly in a second position, opposite of the first position, for volumetrically efficient transportation and/or storage.

It is therefore one of the main objects of the present invention to provide a swimming aid training device that is worn by a swimmer to improve swimming technique.

It is another object of the present invention to provide a swimming aid training device that is worn by a swimmer to swim in a straight line.

It is another object of the present invention to provide a swimming aid training device that is worn by a swimmer to emphasize conditioning of the swimmer's upper torso while swimming.

It is another object of the present invention to provide a swimming aid training device that is worn by a swimmer to minimize use of the swimmer's lower torso while swimming.

It is another object of the present invention to provide a swimming aid training device that is worn by a swimmer when swimming.

It is another object of this invention to provide a swimming aid training device that is light weigh and volumetrically efficient for transportation and storage.

It is another object of the present invention to provide a swimming aid training device that is comfortable to wear.

It is another object of the present invention to provide a swimming aid training device that does not require tools to use, transport, and/or store.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
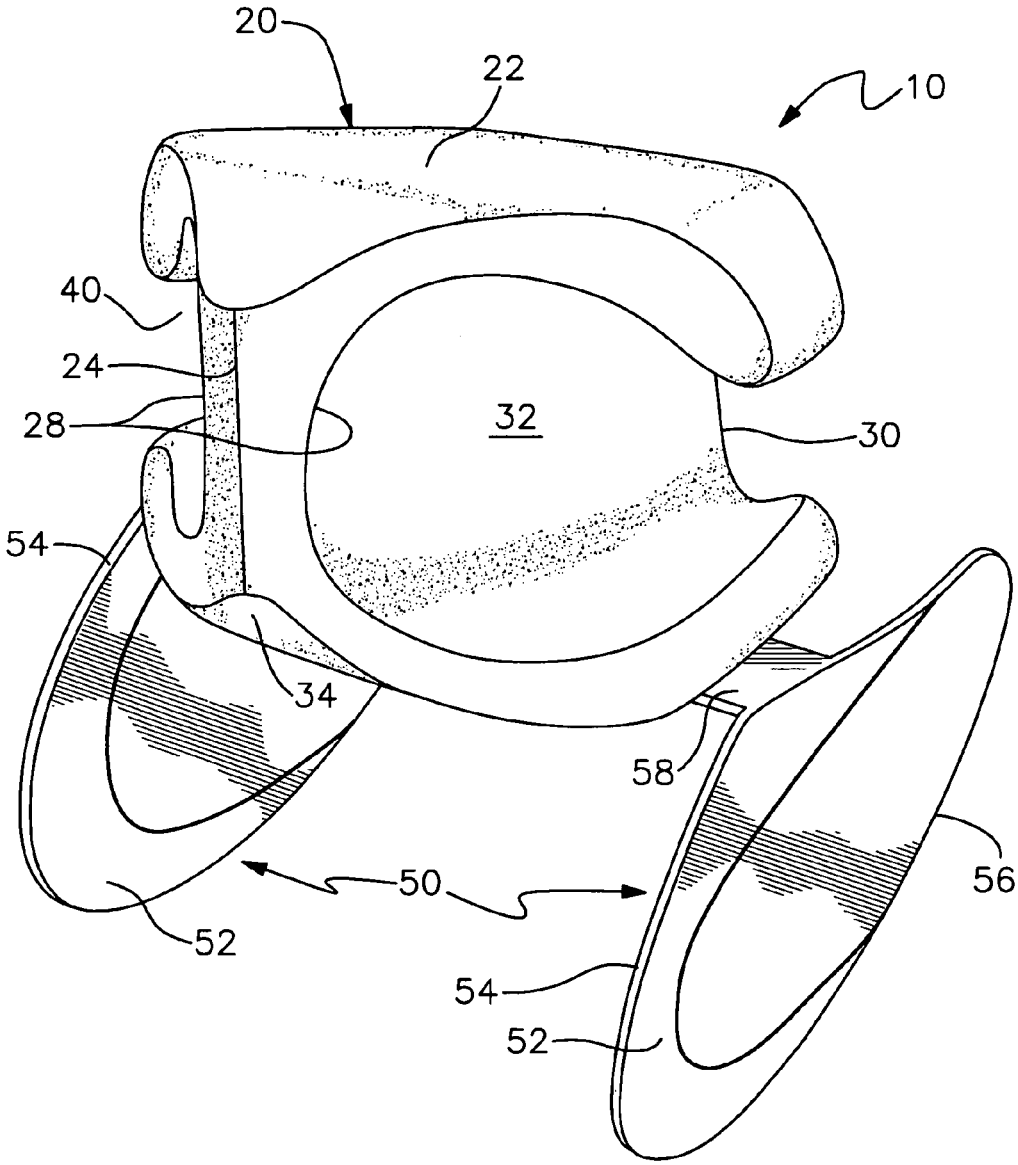
FIG. 1 represents a front isometric view of the instant invention.

Referring now to the drawings, where the present invention is generally referred to with numeral 10, it can be observed that it basically includes buoy assembly 20 and fin assembly 50.

Figure 2:
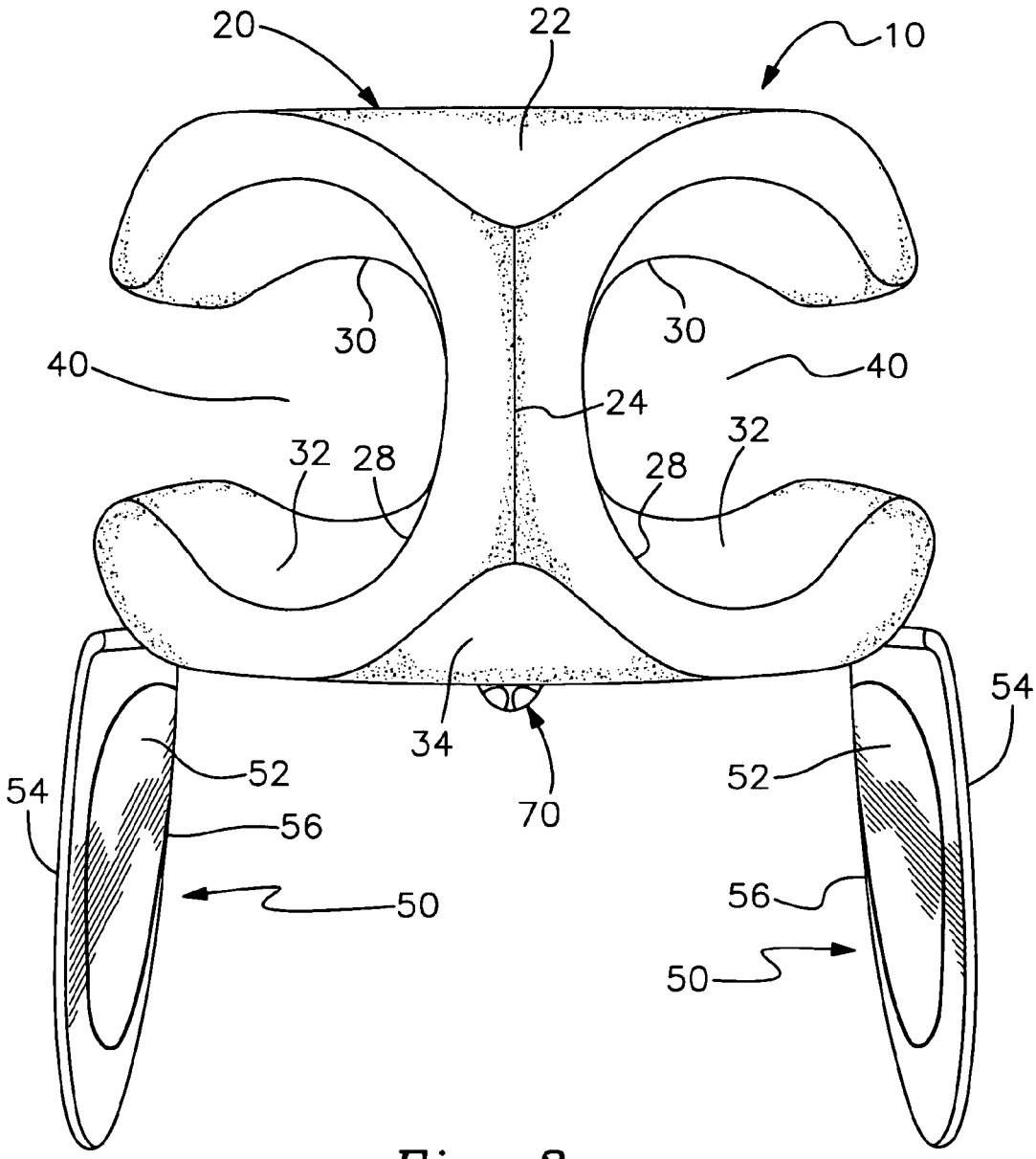
FIG. 2 shows a front elevational view of the instant invention.
Figure 3:
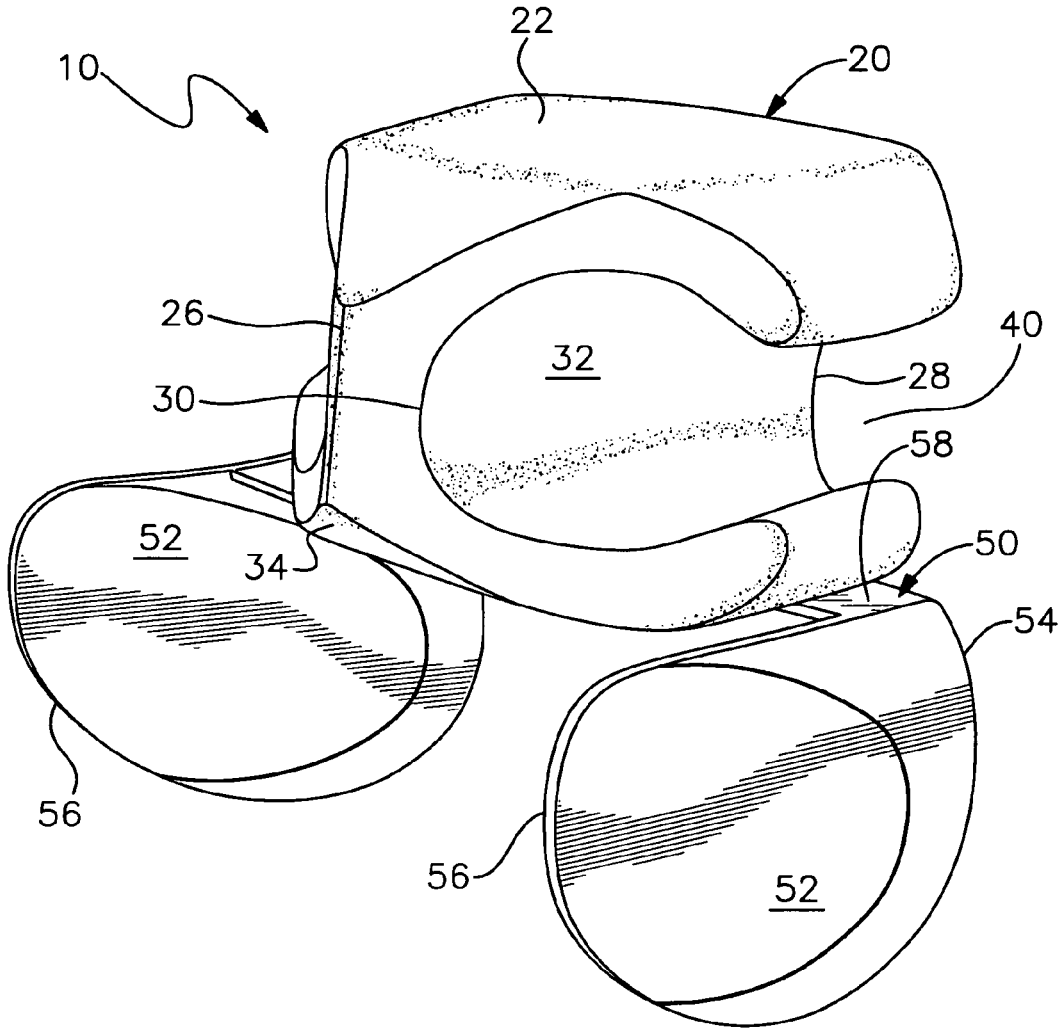
FIG. 3 represents a rear isometric view of the instant invention.

As seen in FIGS. 1; 2; and 3, buoy assembly 20 has a substantially rotated H-shape. In the preferred embodiment, buoy assembly 20 is made of resilient and buoyant material. Buoy assembly 20 comprises top wall 22 and bottom wall 34 that connect by front edge 24 and rear edge 26, seen in FIG. 3, defining front edges 28 and rear edges 30. Side walls 32 are defined between front edges 28 and rear edges 30. As best seen in FIG. 2, front edges 28 define a larger opening space than rear edges 30, and side walls 32 have a C-shape thereby defining bays 40.

Figure 4:
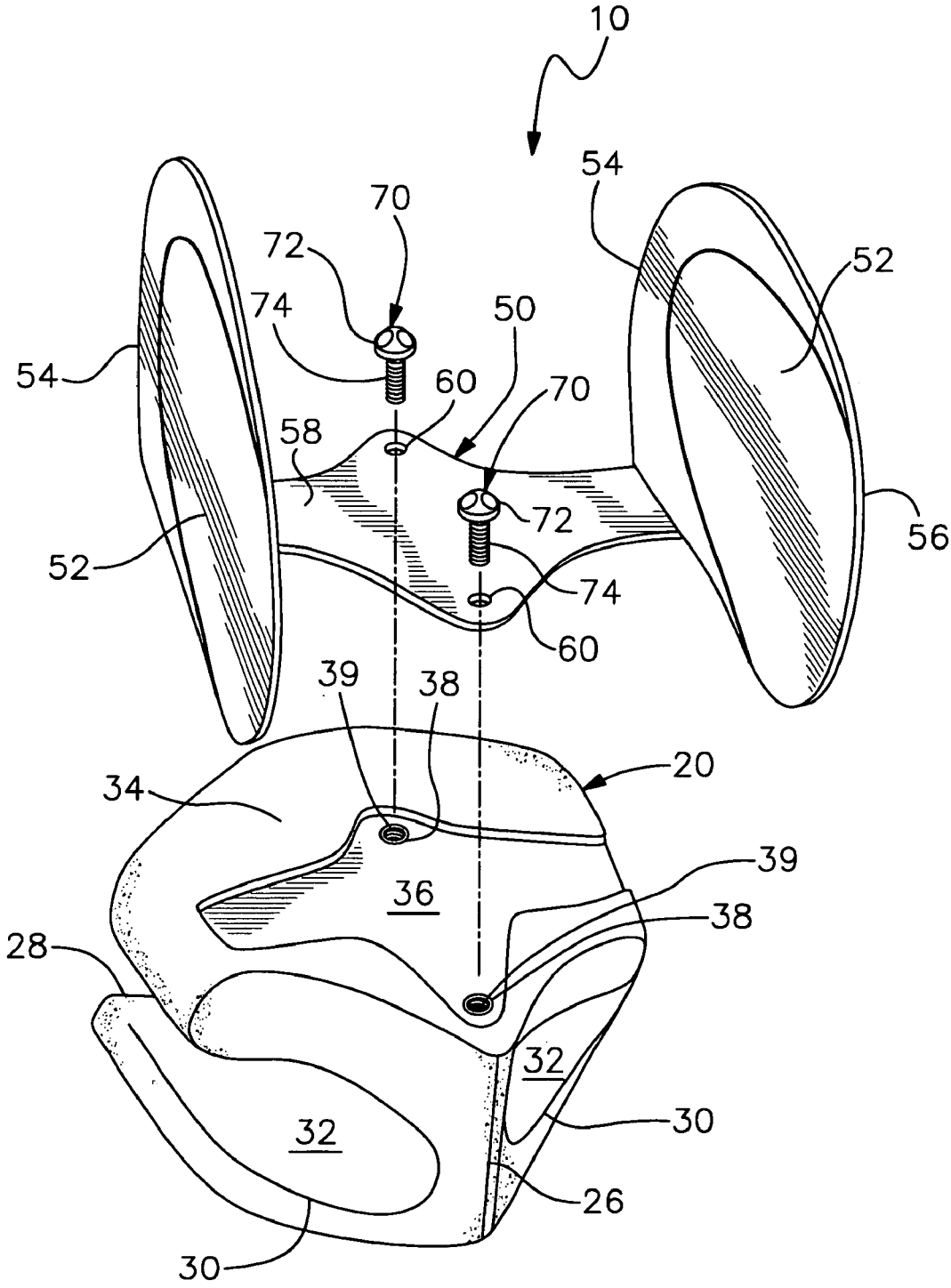
FIG. 4 is a rear exploded view of the instant invention.
Figure 6:
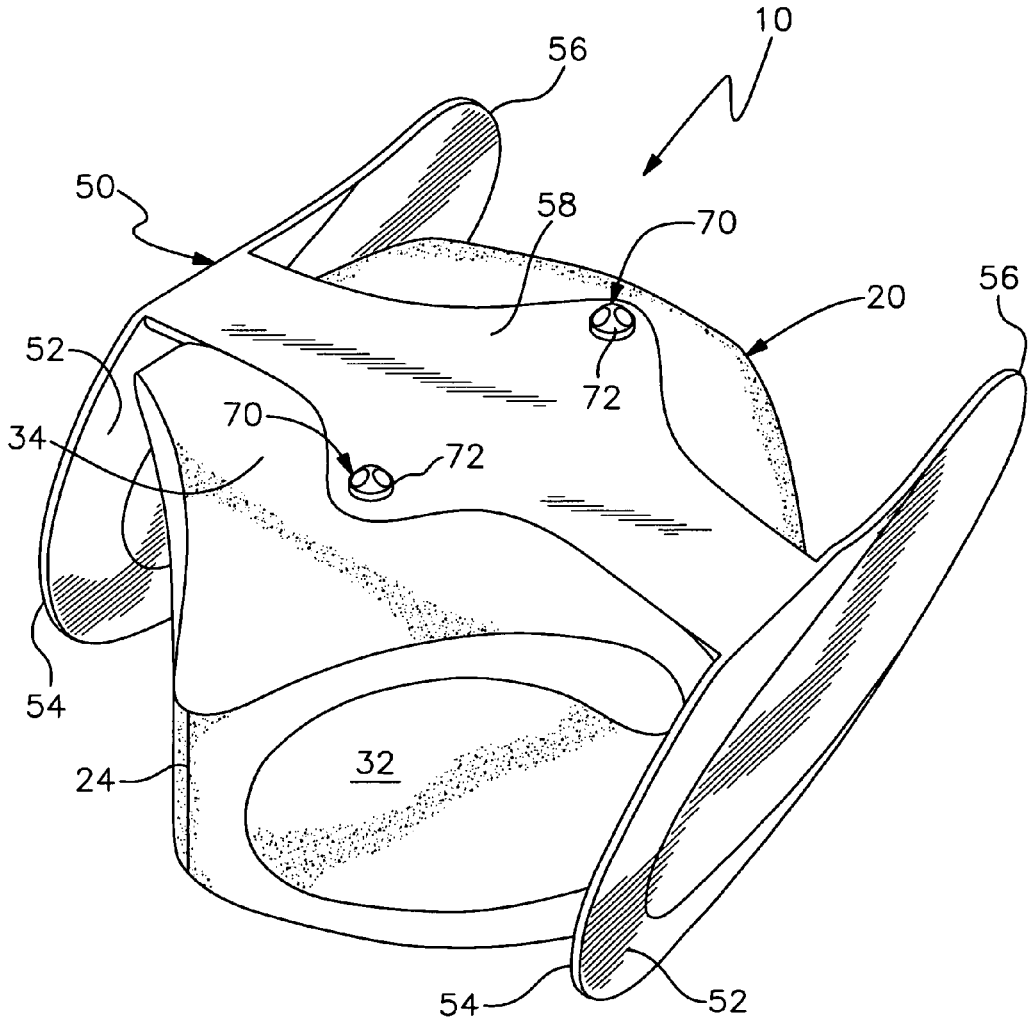
FIG. 6 represents an isometric view of instant invention, assembled in a volumetrically efficient configuration for transportation and/or storage.

As best seen in FIG. 4, bottom wall 34 has depressed surface 36 of a predetermined shape with apertures 38. Fixed within each aperture 38 is a bushing 39. In the preferred embodiment, bushings 39 are cylindrically shaped and have internal threads. Fin assembly 50 comprises fins 52 that are substantially parallel with respect to each other and are kept in a spaced apart relationship by frame 58. Each fin 52 has a front edge 54 and a rear edge 56. Frame 58 has a cooperative shape and dimension to snugly fit into depressed surface 36 of buoy assembly 20. Frame 58 has holes 60 that align with apertures 38 when frame 58 is mounted onto buoy assembly 20. It is noted that holes 60 align with apertures 38 regardless of whether fin assembly 50 is in position for use by a swimmer, such as illustrated in FIG. 1, or whether fin assembly 50 is in position for storage/transportation as illustrated in FIG. 6. Each bolt 70 includes head 72 and threaded portion 74. Head 72 has a cooperative shape and dimension to allow a user to tighten bolt 70 by hand and without the aid of a tool. Bolts 70 fit through holes 60 and into bushings 39 that are within apertures 38, to secure fin assembly 50 to buoy assembly 20.

Figure 5:
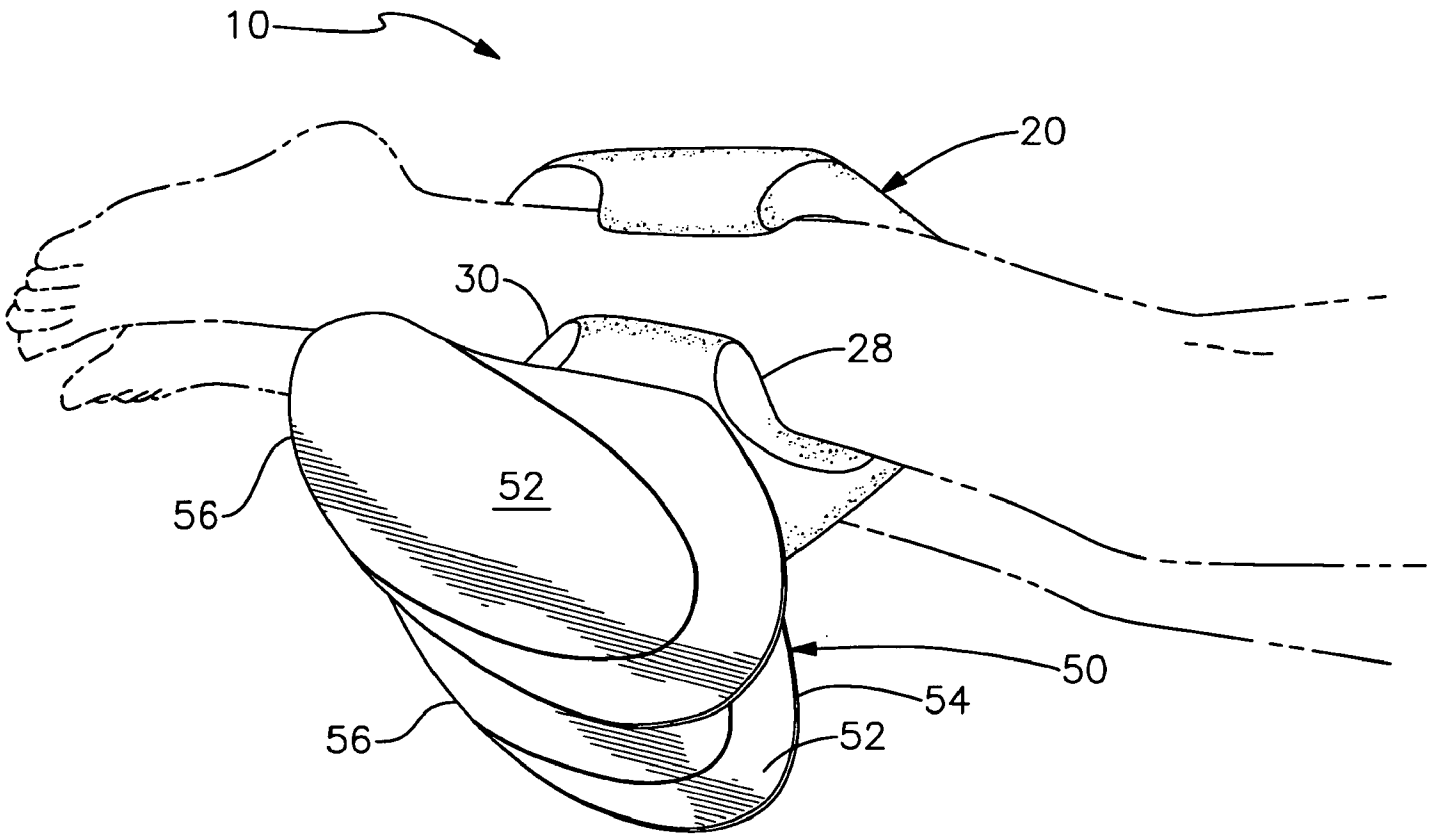
FIG. 5 illustrates the instant invention as worn by a swimmer, between the legs, below the knees and above the ankles.

As seen in FIG. 5, a user is wearing swimming aid training device 10 between the legs. In a body of water, instant invention 10 floats. In its intended usage, front edges 28 are closer to the knees of the user and rear edges 30 are closer to the ankles of the user. As illustrated, in its intended usage, fin assembly 50 and specifically fins 52 point in a downward direction to assist the swimmer to improve technique when swimming. More specifically, instant invention 10 acts as a stabilizer. While freestyle swimming, as one arm is recovering out of the water, the other is producing a propulsive force. Since this force acts to the side of the swimmer's center of gravity, a moment is applied to the body, which causes the swimmer to twist in the water. However, instant invention 10, acting as a stabilizer, prevents the swimmer from twisting the body to minimize drag and maintain a streamlined position to swim in a straight line. It is noted that while using instant invention 10, the swimmer emphasizes conditioning of the swimmer's upper torso and minimizes use of the swimmer's lower torso, since the swimmer maintains his/her legs straight and does not kick for propulsion.

In the preferred embodiment, fin assembly 50 is made of a light and rigid material such as plastic or other material having characteristics of a plastic material.

As seen in FIG. 6, fin assembly 50 is mounted onto depressed surface 36 with fins 52 partially closing the entrance of bays 40. To place instant invention 10 in the illustrated configuration from the configuration illustrated in FIG. 1, the user unscrews bolts 70, flips fin assembly 50 and mounts frame 58 onto depressed surface 36. The user then secures bolts 70 to bushings 39. In this configuration, instant invention 10 is volumetrically efficient for transportation and/or storage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A swimming aid training device, comprising:

A) a buoy assembly (20) having a substantially rotated H-shape; and

B) a fin assembly (50) removably secured to said buoy assembly (20) in a first position, said fin assembly (50) comprising at least two fins (52) and a frame (58), said at least two fins (52) are kept in a spaced apart relationship by said frame (58), said fin assembly (50) is a stabilizer to prevent a swimmer from twisting in a body of water to minimize drag and maintain a streamlined position when freestyle swimming, said buoy assembly (20) is worn above both ankles and below both knees of said swimmer.

2. The swimming aid training device according to claim 1, further characterized in that said buoy assembly comprises top wall (22) and bottom wall (34) that connect by front edge (24) and rear edge (26) to define front edges (28) and rear edges (30), said buoy assembly further comprises side walls (32) that are defined between said front edges (28) and said rear edges (30).

3. The swimming aid training device according to claim 2, further characterized in that said front edges (28) define a larger opening space than said rear edges (30).

4. The swimming aid training device according to claim 3, further characterized in that said side walls (32) have a C-shape thereby defining bays (40).

5. The swimming aid training device according to claim 4, further characterized in that said at least two fins (52) are substantially parallel.

6. The swimming aid training device according to claim 2, further characterized in that said bottom wall (34) comprises depressed surface (36) of a predetermined shape to snugly receive said frame (58) when said fin assembly (50) is removably secured to said buoy assembly (20).

7. The swimming aid training device according to claim 6, further characterized in that said depressed surface (36) comprises at least two apertures (38) each having a bushing (39), said bushing (39) is cylindrically shaped and has internal threads.

8. The swimming aid training device according to claim 7, further comprising bolts (70) having heads (72) and threaded portions (74), said heads (72) having a cooperative shape and dimension to allow said swimmer to tighten said bolts (70) by hand, each said bolts (70) tighten into said bushing (39) to secure said fin assembly (50) to said buoy assembly (20).

9. The swimming aid training device according to claim 8, further characterized in that said buoy assembly (20) is made of a resilient and buoyant material.

10. The swimming aid training device according to claim 9, further characterized in that said fin assembly (50) is removably secured to said buoy assembly (20) in a second position, opposite of said first position, for volumetrically efficient transportation and/or storage.

* * * * *